US005757324A

United States Patent [19]

Helms et al.

[11] Patent Number: 5,757,324

[45] Date of Patent: May 26, 1998

[54] LOW PROFILE ANTENNA ARRAY FOR LAND-BASED, MOBILE RADIO FREQUENCY COMMUNICATION SYSTEM

[75] Inventors: Darrell L. Helms, Seminole; David A. Boyd, Largo; Anton S. Gecan, St. Petersburg, all of Fla.

[73] Assignee: E-Systems, Inc, Dallas, Tex.

[21] Appl. No.: 880,827

[22] Filed: Jun. 23, 1997

Related U.S. Application Data

[63] Continuation of Ser. No. 513,511, Aug. 10, 1995, abandoned.

[51] Int. Cl.[6] ..... H01Q 1/38

[52] U.S. Cl. ..... 343/700 MS; 343/872; 343/890

[58] Field of Search ..... 343/700 MS, 890, 343/891, 853, 893, 872; H01Q 1/38

[56] References Cited

U.S. PATENT DOCUMENTS

| | | | |
|---|---|---|---|
| 2,771,606 | 11/1956 | Kandoian | 343/890 |
| 2,778,015 | 1/1957 | Chu | 343/890 |
| 3,303,506 | 2/1967 | Diebold | 343/890 |
| 3,409,893 | 11/1968 | Siukola | 343/891 |
| 4,987,421 | 1/1991 | Sunahara et al. | 343/700 MS |
| 5,327,148 | 7/1994 | How et al. | 343/700 MS |
| 5,333,002 | 7/1994 | Gans et al. | 343/700 |
| 5,363,115 | 11/1994 | Lipkin et al. | 343/872 |
| 5,367,307 | 11/1994 | Dupuis et al. | 343/700 |
| 5,467,955 | 11/1995 | Beyersmith | 343/890 |

OTHER PUBLICATIONS

Zurcher et al. "Broadband Patch Antennas," published by Artech Florge Inc. 1995, pp. 139–159.

*Primary Examiner*—Donald T. Hajec
*Assistant Examiner*—Tho Phan
*Attorney, Agent, or Firm*—Baker & Botts, L.L.P.

[57] ABSTRACT

An antenna for a land-based, mobile radio communication system, having a reduced size and shape, includes three, flat antenna dielectric panels, each covering one hundred, twenty degrees of azimuth. On each dielectric panel is formed two, interleaved microstrip antenna arrays having narrow vertical beam width. One of the antenna arrays receives signals and the other antenna array transmits signals. The receive array is circularly polarized. The panels are mounted in a triangular configuration about a central mast and a cylindrically shaped radome encloses the dielectric panels.

11 Claims, 2 Drawing Sheets

LOW PROFILE ANTENNA ARRAY FOR LAND-BASED, MOBILE RADIO FREQUENCY COMMUNICATION SYSTEM

This is a continuation of Ser. No. 513,511, filed Aug. 10, 1995, abandoned.

FIELD OF INVENTION

The invention relates generally to antenna arrays, and more particularly to low-profile antenna arrays for land-based, mobile radio frequency communication systems.

BACKGROUND OF THE INVENTION

Mobile radio frequency communication systems, which include the conventional "cellular" systems and the new personal communications systems or PCS, are currently enjoying wide-spread use throughout the country and the world. Most major urban and suburban areas have at least one, if not two, systems. With new frequency bands being allocated in the United States for PCS, additional systems are expected to be installed in these areas. As the number of systems and the mobile subscribers in a given area increase, so too does the number of antennas. However, due to the size and appearance of conventional cellular antennas, suitable sites are expected to become more difficult to find, especially in urban and suburban areas.

In cellular and currently proposed PCS systems, a territory that is being serviced by a system is divided into multiple "cells." At the center of each cell is located a base station. The base station transmits and receives radio frequency signals carrying voice and data to and from mobile radio telephones currently located within that cell. The base stations are interconnected through a central, cellular switching office. The cellular switching office is, in turn, usually connected by conventional telephone wiring capable of handling many simultaneous calls (called a "trunk") to a conventional local telephone network. Since each cell has only a limited number of channels available, system capacity can be increased only by further subdividing the area into a greater number of cells. Additional systems in the same geographic area provide additional capacity for the same territory, but they also require additional base stations and antennas. Increasing capacity in a territory thus requires additional antennas.

Unfortunately, conventional antennas for land-based, mobile communication systems are large, bulky and generally considered to be aesthetically unpleasing. Owners or neighbors of suitable sites, especially in urban and suburban areas, often object to the unsightliness of the antennas.

The large size and unsightliness of antennas are due in part to several constraints imposed by, or requirements for, a land-based mobile radio communication system. First, the antenna array generally must be capable of simultaneously transmitting and receiving radio frequency signals. Thus, it must have separate transmitting and receiving antenna elements. Second, both the receiving and transmitting antennas must be, in most cases, omnidirectional, meaning that the antenna must be capable of transmitting and receiving in all horizontal directions. Third, the antennas must have high gain. The antenna not only must contend with the low power of the mobile telephones, but also the effects on the signal peculiar to a land-based mobile communication system such as fading of signals caused by the natural terrain, man-made structures and movement of the mobile radio telephone. Noise and interference in urban areas may also be high. Consequently, an omnidirectional antenna is usually made of several directional antennas, each having a narrower horizontal beam width to increase gain. Furthermore, since all receivers and transmitters fall generally within a plane near the ground, the vertical beam widths are narrowed to further increase gain. Vertically stacking several antenna elements in an array narrows vertical beam width. Third, signals transmitted from a mobile user may reflect off other structures and objects before being received by the antenna and become randomly polarized. To assure adequate gain, the array is preferably dual-polarized to receive both vertically and horizontally polarized signals by providing a second linear antenna array. Also, having both polarizations helps assure adequate reception from hand-held mobile units, whose antennas may be oriented vertically, horizontally or in between when the unit is held near the ear. Fourth, reflected signals also create multipath fading and may also become cross-polarized. To overcome these problems, the two receiving antenna arrays are spacially separated (space diversity) to provide diversity gain.

An antenna that satisfies these constraints tends to be a large, rather tall, ungainly and unattractive structure. For example, in one type of antenna installation, there are three sets of directional antenna arrays, each covering one hundred, twenty degrees of azimuth, that are supported on a pole or mast above the ground. In each set are two vertically polarized arrays and one horizontally polarized array of wire dipole elements. The bottom array is used for receiving, the middle array for transmitting and the top array for receiving. Using two, spatially separated arrays enhances diversity gain of incoming signals. The resulting structure can be greater than thirty feet in height, depending on the exact range of frequencies to which the antenna is tuned.

Due to the increasing use of mobile communication devices, there is a need therefore for a antenna configuration for use in land-based, mobile radio communication system that has a generally smaller size and a more pleasing appearance, that meets the requirements noted above, particularly high gain and good diversity gain.

SUMMARY OF THE INVENTION

The invention relates to an antenna structure for base stations of a land-based, radio communication systems and the like. The invention overcomes the limitations placed on such antennas to provide an antenna having a substantially smaller and narrower physical profile as compared to conventional prior art antennas, without sacrificing performance. The comparatively small profile allows for the antenna's placement in confining areas often found in urban landscapes. Its small profile also permits it to be completely encloses within a radome that results, as compared to conventional antennas, in a more aesthetically pleasing size, shape and appearance.

An antenna in accordance with the invention includes one or more directional arrays formed on one or more flat panels from a plurality of flat "patches" of metal deposited on a panel. Each patch functions as a separate radiating element. The panels, being relatively flat, reduce the overall width and depth of the array as compared to one with wire dipole radiators, resulting in a narrower overall profile of the assembled antenna The entire antenna is enclosed within a low-profile radome. The radome not only protects the antenna elements from weather, it also provides several important advantages. It is aesthetically pleasing, especially given the relatively small size of the antenna. It provides minimal environmental impact. Birds, for example, are unable to nest in the structure. It offers low wind resistance.

Thus, since wind loading is reduced, the antenna tends to cost less to erect. It also can be more safely serviced.

In one embodiment, an array panel includes two linear arrays of "microstrip" or "patch" antenna elements, one array for receiving and one for transmitting. To reduce the vertical height of the antenna while still providing a narrow elevational or vertical beam width for greater gain, the patches of the transmitting array and the receiving array are interleaved, meaning that the elements of each array alternate with those of the other array. Furthermore, the patches for the receiving array are dual-linearly polarized by locating two, mutually-orthogonal feed points on the patch. A second receiving array is unnecessary for provide dual linear horizontal and vertical polarization. Additionally, when using an antenna according to the invention, a second, spacially separated receiving array is not required to provide adequate diversity gain.

To provide omnidirectional coverage, a plurality of panel arrays are arranged vertically in polygonal fashion around a support mast. Due to the relatively narrow width and flatness of the panels, the resulting antenna has a relatively narrow profile. A cylindrically shaped radome encloses the panel. The mast supports the radome in a vertical position. The patches in each array are connected to a power splitter having a single output coupled to a connector in a mounting plate located at the bottom of the radome. The connectors are thus protected from weather when the antenna is surface-mounted and no cabling or other lines are visible or readily accessible once the antenna is mounted. Without exposed cables, the antenna is secured against vandalism minimizing the need for fencing and, further, the antenna is attractive enough to be placed in many areas in which conventional antennas would not otherwise be welcomed.

For a cellular system operating at 800–900 Mhz, the overall dimensions of an antenna according to one embodiment of the invention are approximately 9 feet tall and 1.25 feet in diameter. A conventional antenna has sides in the range of approximately eight feet by thirteen feet, with a thirteen by thirteen by thirteen base, for the same frequencies.

These and other aspects and advantages of the invention are apparent from the following description of the accompanying drawings illustrating a preferred embodiment of the invention.

DETAILED DESCRIPTION

In the following description, like numbers refer to like parts.

Figure 1:
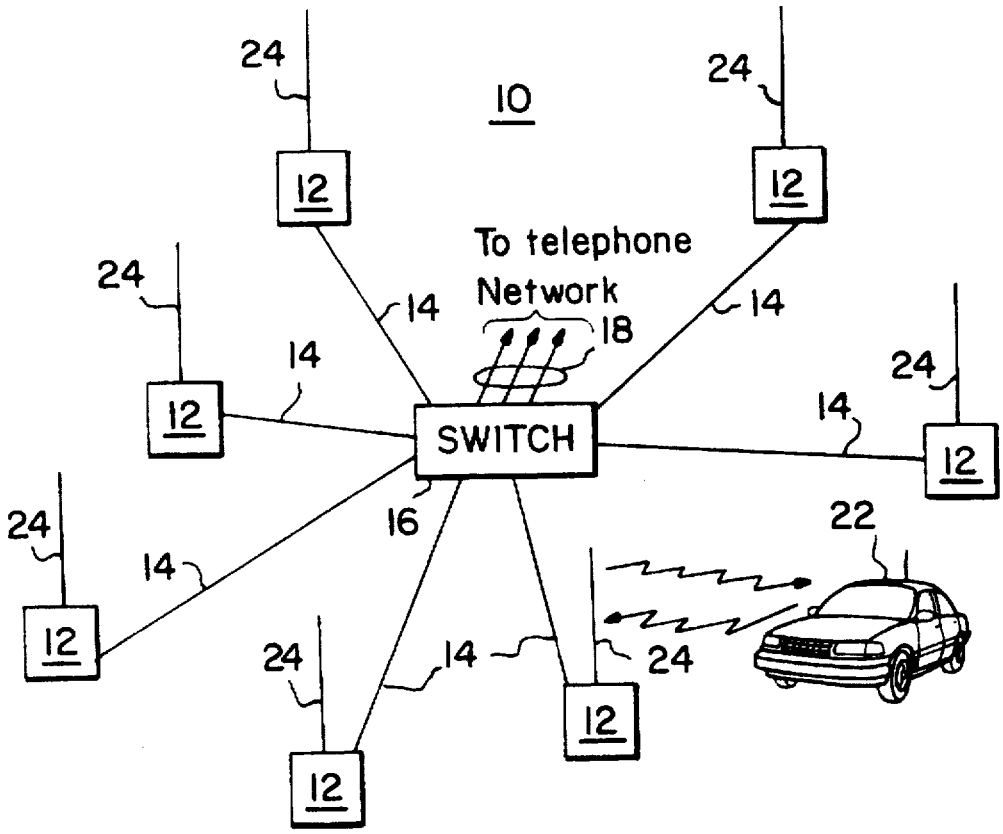
FIG. 1 is a schematic representation of a conventional land-based, mobile radio communication system.

FIG. 1 is a schematic representation of a land-based mobile communication system 10 which is well-known in the art and is intended to be representative of all such systems. The system includes a plurality of base stations 12, one for each cell (not indicated). Each base station is linked by a land-line 14 to a mobile communications switching office 16. The mobile communication switching office connects with a local telephone system via trunk lines 18. Each base station includes an antenna 24 connected to a radio frequency transmitter and receiver (not shown). The base station simultaneously broadcasts and receives radio frequency signals over preassigned channels within a given frequency band. Communication between the base station and a mobile radio frequency transmitter and receiver, or mobile telephone, which is carried in, for example, automobile 22, is full duplex. The antenna 24 is usually located in the center of each cell and generally broadcasts and receives signals in all directions of azimuth. However, an antenna's radiation pattern may, if necessary, be adjusted to provide greater coverage in one direction according to well known principles.

Figure 2:
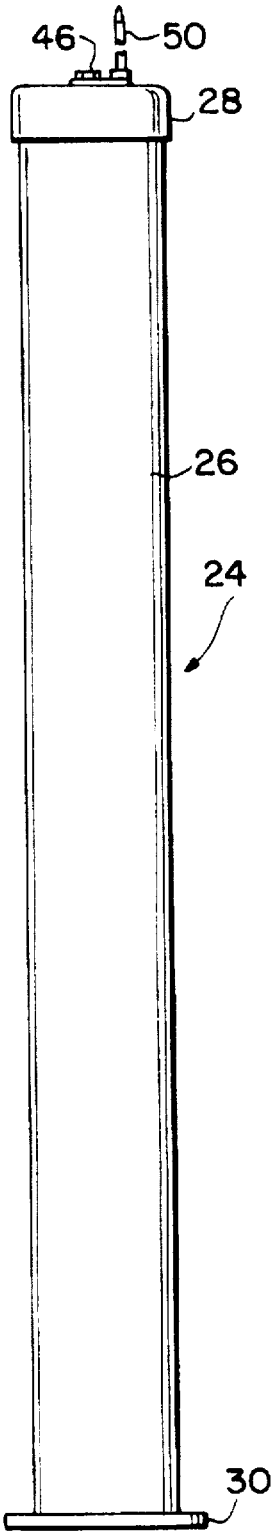
FIG. 2 is an elevational view of the exterior of an antenna for a land-based, mobile radio communication system in accordance with the present invention.

FIG. 2 illustrates an antenna 24 suitable for use in a land-based, mobile radio communication system such as shown in FIG. 1 or other similar systems. The antenna is enclosed by a generally rigid, cylindrically-shaped radome 26 formed of dielectric material On top of the cylinder is a removable cap 28 for sealing the top of the radome and providing access to antenna elements located inside. A mounting base 30 for attaching the antenna to a structure or other object is connected to the bottom of the radome and seals the bottom of the radome.

Figure 3:
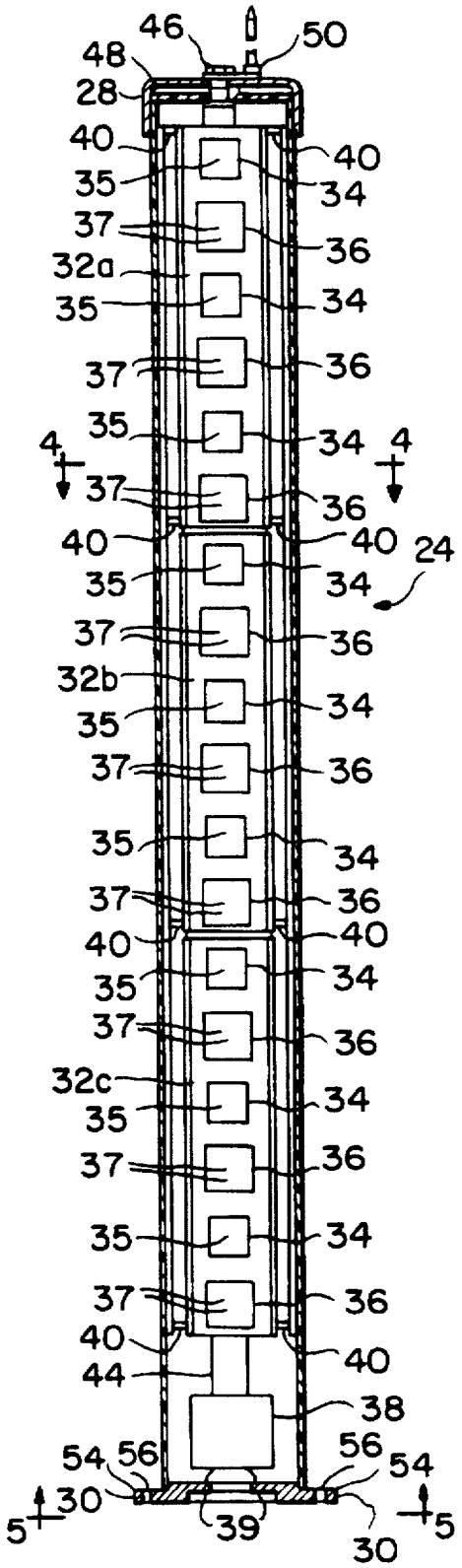
FIG. 3 illustrates the antenna of FIG. 2 with a side portion of a radome cover cut-away.

FIG. 3 is an elevational view of antenna 24 with a front portion of the radome 26 cut-away to reveal a flat or planar antenna panel 32. The panel is comprised of three sections **32*a*, 32*b* and 32*c* of dielectric material arranged end-to-end. Etched in a conventional manner on the outer surface of the three dielectric sheets are nine transmit microstrip patches 34 and nine receive microstrip patches 36 forming, respectively, a linear transmit array and linear receive array. Each array is vertically oriented for a narrow vertical beam width for aiming in a direction generally parallel to the ground. The transmit patches 34 are interleaved or alternated with the receive patches 36. On the back of the dielectric is a layer of metal (not visible) that forms a ground plane. Each transmit patch 34 is fed signals through the back of the panel 32 using probe attached to a conventional coaxial connector (not shown). A tip 35 of each connector's feed probe is connected to the transmit patch 34. Each receive patch 36 is dual linearly polarized by feeding the patch from the rear at two points, orthogonal to each other with respect to the center of the patch, using conventional coaxial connectors (not shown). A tip 37 of each connector's feed probe is connected to the receive patch 36**. Alternately, the transmit and the receive patches can be fed by microstrip transmission lines deposited on the outer layer of the dielectric panel.

The connectors of the transmit patches 34 in the transmit array on a panel are connected by coaxial cable to a first power splitter in order to combine the signals from all transmit patches into a single signal for transmission to a radio receiver. In a similar manner, vertical polarization connectors from each receive patch 36 in the receive array are connected to a second power splitter, and the horizontal polarization connectors from the receive array are connected to the third power splitter. For simplicity, the three power splitters are schematically represented by box 38 and coaxial cables connecting each patch to the respective power splitter are omitted. The output of each power splitter is provided to a coaxial connector 38. A group of three connectors 39 are shown in FIG. 3, one for the transmit array and two for the receive array of panel 32, extending through the bottom of mounting plate 30 for connection to cables from the transmitters and receivers to the base station.

Figure 4:
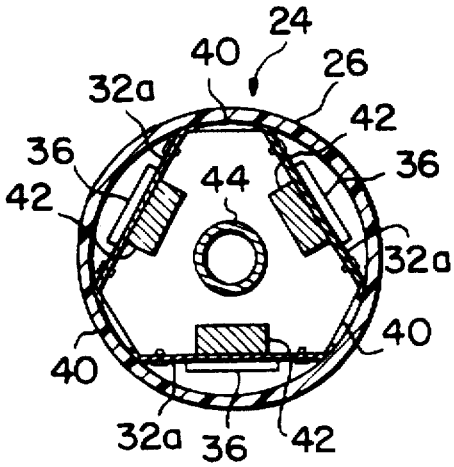
FIG. 4 is a cross-section of the antenna of FIG. 3 taken along section line 4—4 of FIG. 3; and, FIG 5 is a plan view of the bottom of the antenna of FIG. 2.

FIG. 4 is a cross-section of antenna 24, taken generally along section line 4—4 in FIG. 3. It will be described with reference also to FIG. 3. An omnidirectional version of the antenna includes three panels 32. Each panel is substantially identical and has been described with reference to FIG. 3. Each panel covers a complementary one hundred, twenty degree sector of azimuth about the antenna, thus providing antenna 24 with omnidirectional coverage. Each panel is backed by a grounded aluminum member 42, bonded with a conducting epoxy to the metal layer (not visible) on back of the dielectric sheets 32*a*, 32*b* and 32*c*. The panels are bolted to support brackets 40. Antenna 24 is easily reconfigurable by, for example, removing one or two panels to create an antenna having a directional radiation pattern for cells which do not require an omnidirectional radiation pattern. Additional panels, each with narrower horizontal beam widths, can be set in a polygonal fashion within a cylindrical radome.

The assembly of the three panels 32 and the radome 26 is supported in a vertical position by a central pole or mast 44. The mast is connected to mounting plate 30 and forms an electrical connection therewith for grounding the mast. Bolt 46 (FIG. 3) is threaded into the top of the mast through a sleeve in a plate 48 and opening in cap 28, and holds both in place. Plate 48 (FIG. 3), pushing against the top edge of the radome cylinder 26, forces the bottom of the cylindrical radome 26 against the mounting plate 30. The mounting plate 30 includes a raised circular shoulder to center the radome 26 on the plate and assist in forming a seal between the radome and plate. The bolt 46 also extends through a bracket for supporting a lightening rod 50.

Antenna 24 is easily reconfigurable. One or more panels may be recovered to provide an antenna having a more directional radiation pattern. Additional antenna panels, each with a narrower horizontal beam width, can be added and oriented in a polygonal fashion about the central mast, within the cylindrical radome. Alternately, a single panel, such as panel 32, may be enclosed within a radome and mounted flat against a wall or side of a building for directional coverage. Mounting additional panels to other surfaces of the building can provide greater horizontal coverage. A panel array also easily lends itself to mechanical tilting for beam adjustments. Additionally, a single panel may include an N by M arrays of patch elements to provide electronic beam steering capability.

Figure 5:
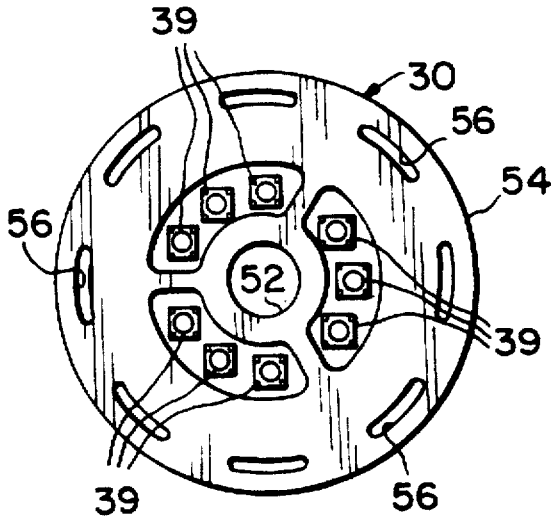

FIG. 5 shows the bottom side of the mounting plate 30. It will also be described with reference also to FIG. 3. The mast 44 (FIG. 3) is attached to the plate 30 through an opening 52. The portion of the plate extending beyond the outer circumference of the radome 26 forms a flange 54. The antenna 24 is mounted to a support surface by bolts or similar fasteners extending through slots 56 defined in the flange 43. Within each group of connectors 39, one connector serves as an input to the transmit array and two connectors serve as outputs for the horizontally and vertically polarized signals from the receive array.

The foregoing description is of a preferred embodiment of the invention and is made for purposes of explaining various aspects and advantages of the invention. The invention, however, is not limited to the embodiment shown. Rearrangements, substitutions and other modifications to the illustrated embodiment may be made without departing from the invention. The scope of the invention is defined only by the appended claims.

What is claimed is:

1. An antenna for a mobile radio communication system, comprising:

at least one dielectric panel having first and second oppositely disposed planar surfaces and a longitudinal axis;

a first array including a plurality of spaced apart receiving microstrip antennas for receiving signals input to the mobile radio communication system, the first array formed in a linear configuration on the first planar surface of the dielectric panel along the longitudinal axis;

a second array including a plurality of spaced apart transmitting microstrip antennas for transmitting signals from the mobile radio communication system, said second array formed in a linear configuration on the first planar surface of the dielectric panel along the longitudinal axis, said plurality of transmitting microstrip antennas being disposed adjacent to and alternately spaced between said plurality of receiving microstrip antennas along the longitudinal axis;

said plurality of receiving microstrip antennas receiving signals input to the mobile radio communication system and said plurality of transmitting microstrip antennas transmitting signals from the mobile radio communication system simultaneously;

means for coupling the first and second arrays to a base station of the mobile radio communication system; and a radome enclosing the at least one dielectric panel.

2. The antenna of claim 1 wherein each microstrip antenna of the first array further includes dual orthogonal feed points for dual-linear horizontal and vertical polarization, said feed points located on each microstrip antenna of the first array.

3. The antenna of claim 1 further comprising:

a second dielectric panel and a third dielectric panel each having first and second oppositely disposed planar surfaces, a first, linear array of a plurality of spaced apart receiving microstrip antennas for receiving signals and a second, linear array of a plurality of spaced apart transmitting microstrip antennas, said plurality of transmitting microstrip antennas being disposed adjacent to and alternately spaced between said plurality of receiving microstrip antennas along the longitudinal axis;

said transmitting microstrip antennas and said receiving microstrip antennas of said second and third dielectric panels operating simultaneously; and a central mast for supporting the first, second and third dielectric panels to provide omnidirectional radiation coverage, said second planar surfaces of said panels disposed adjacent to said mast wherein the radome comprises a substantially cylindrical structure enclosing the first, second and third dielectric panels.

4. The antenna of claim 3 further comprising a mounting plate for attaching the radome and the central mast to a supporting surface and a plurality of connectors extending through the mounting plate for electrical connection to the at least one dielectric panel.

5. The antenna of claim 1 wherein said means for coupling comprises a first power splitter and a first coaxial cable connected to said second array of microstrip antennas and to said first power splitter to combine the transmitting signals into a single signal for transmission.

6. The antenna of claim 5 wherein said means for coupling comprises second and third power splitters and second and third coaxial cables connected to said first array of microstrip antennas and to a corresponding second and third power splitter to separately combine the received signals.

7. An antenna for a mobile radio communication system, comprising:

a plurality of dielectric panels_ each panel having first and second oppositely disposed planar surfaces and a longitudinal axis;

a first array including a plurality of spaced apart receiving microstrip antenna elements for receiving signals input to the mobile radio communication system, the plurality of receiving microstrip antenna elements formed in a linear configuration on the first planar surface of each dielectric panel along the longitudinal axis;

a second array including a plurality of transmitting microstrip antenna elements for transmitting signals from the mobile radio communication system, said plurality of transmitting microstrip antenna elements formed in a linear configuration on the first planar surface of each dielectric panel, said plurality of transmitting microstrip antenna elements being disposed adjacent to and alternately spaced between said plurality of receiving microstrip antenna elements along the longitudinal axis;

said plurality of receiving microstrip antenna elements receiving signals input to the mobile radio communication system and said plurality of transmitting microstrip antenna elements transmitting signals from the mobile radio communication system simultaneously;

means for coupling the first and second arrays on each dielectric panel to a base station of the mobile radio communication system; and means for mounting the dielectric panels together, said means for mounting including means for orienting each dielectric panel to provide selected angular azimuth coverage.

8. The antenna of claim 7 wherein there are at least two dielectric panels of linear arrays, and the means for assembling includes means for supporting the dielectric panels in a polygonal configuration about a center mast.

9. The antenna of claim 7 wherein there are three dielectric panels of linear arrays, each having a horizontal beam width covering substantially one hundred twenty degrees of azimuth, and the means of assembling includes means for supporting the dielectric panels in a triangular configuration about a center mast.

10. An antenna for a mobile radio communication system, comprising:

a plurality of dielectric panels, each panel having first and second oppositely disposed planar surfaces and a longitudinal axis;

a first array including a plurality of spaced apart receiving microstrip patch antennas for receiving signals input to the mobile communication system, said first array formed in a linear configuration on the first planar surface of the dielectric panel along the longitudinal axis;

two orthogonal feed points for each of the receiving microstrip patch antennas of the first array, said two orthogonal feed points providing dual linear horizontal and vertical polarization, said feed points coupled to a surface of each microstrip patch antenna;

a second array including a plurality of spaced apart transmitting microstrip patch antennas, said plurality of transmitting microstrip patch antennas being disposed adjacent to and alternately spaced between said plurality of receiving microstrip patch antennas along the longitudinal axis, said transmitting microstrip patch antennas and said receiving microstrip patch antennas of said plurality of dielectric panels operating simultaneously;

means for mounting each panel about a central mast in a generally polygonal configuration for providing wide azimuth coverage with a relatively narrow beam width for communication with the mobile radio communication system said second planar surface of said panels being disposed adjacent said mast; and a cylindrical shape radome enclosing the dielectric panels.

11. An antenna for a mobile radio communication system, comprising:

a plurality of dielectric panels, each panel having first and second oppositely disposed planar surfaces and a longitudinal axis;

a first array including a plurality of spaced apart transmitting microstrip patch antennas for transmitting signals from the mobile radio communication system;

each transmitting microstrip antenna of the first array formed in a linear configuration on the first planar surface of each dielectric panel along the longitudinal axis;

a second array including a plurality of spaced apart receiving microstrip patch antennas for receiving signals input to the mobile radio communication system, said plurality of receiving microstrip patch antennas being disposed adjacent to and alternately spaced between said plurality of transmitting microstrip patch antennas alone the longitudinal axis, said transmitting microstrip patch antennas and said receiving microstrip patch antennas of said plurality of dielectric panels operating simultaneously;

means for mounting each dielectric panel about a central mast in a substantially polygonal configuration for providing width azimuth coverage with a relatively narrow beam width for communication with the mobile radio communication system said second planar surface of said panels being disposed adjacent said mast; and cylindrical shaped radome enclosing the dielectric panels.

* * * * *